US005605193A

United States Patent [19]

Bearden et al.

[11] Patent Number: 5,605,193

[45] Date of Patent: Feb. 25, 1997

[54] DOWNHOLE GAS COMPRESSOR

[75] Inventors: John L. Bearden, Claremore; Ketankumar K. Sheth, Tulsa; Fred S. Martin, Claremore, all of Okla.

[73] Assignee: Baker Hughes Incorporated, Houston, Tex.

[21] Appl. No.: 497,197

[22] Filed: Jun. 30, 1995

[51] Int. Cl.[6] ..... E21B 43/00

[52] U.S. Cl. ..... 166/370; 166/105.6; 417/66

[58] Field of Search ..... 166/265, 305.1, 166/369, 370, 372, 374, 105.5, 105.6; 417/66, 394, 464

[56] References Cited

U.S. PATENT DOCUMENTS

| | | | |
|---|---|---|---|
| 3,887,008 | 6/1975 | Canfield | 166/267 |
| 4,224,805 | 9/1980 | Rothwell | 166/45 X |
| 4,316,703 | 2/1982 | Kunzelman | 417/66 |
| 4,530,646 | 7/1982 | McCoy | 417/464 |
| 4,648,449 | 3/1987 | Harrison | 166/249 |
| 4,896,725 | 1/1990 | Parker et al. | 166/267 |
| 5,025,862 | 6/1991 | Showalter | 166/303 |
| 5,147,185 | 9/1992 | Niehaus et al. | 417/394 |
| 5,450,901 | 9/1995 | Ellwood | 166/266 |

*Primary Examiner*—Frank Tsay
*Attorney, Agent, or Firm*—James E. Bradley

[57] ABSTRACT

A gas compressor is employed downhole in a well for pressurizing formation gas. The gas compressor is driven by a downhole electrical motor. The downhole assembly also includes a pump. The pump might be located below the motor and driven by the same motor. In that event, the pump pumps liquid being produced by the formation downward to a liquid disposal formation. Also, the pump may pump the liquid to the surface, with the gas being delivered into a repressurizing zone.

20 Claims, 2 Drawing Sheets

DOWNHOLE GAS COMPRESSOR

BACKGROUND OF THE INVENTION

1. Field of the invention

This invention relates in general to oil, water and gas wells, and in particular to a means for handling low pressure gas produced in a well by the use of a downhole gas compressor.

2. Description of the Prior Art

Electrical submersible pumps are commonly used in oil wells. Electrical submersible pumps have found particular applications in wells which produce a large ratio of water relative to the oil, and wherein the formation pressure is not sufficient for the well to flow naturally. A typical electrical submersible pump is centrifugal, having a large number of stages of impellers and diffusers. The pump is mounted to a downhole electrical motor and the assembly is supported in the well on production tubing. A power cable extends alongside the tubing to the motor for supplying power from the surface.

In some instances, a well will also produce quantities of gas along with the liquid. Centrifugal pumps are designed for pumping incompressible liquids. If a sufficient amount of gas is present, the pump will lose efficiency because gas is compressible. Gas separators have been employed to reduce the amount of gas entering the centrifugal pump. A gas separator separates a mixture of liquid and gas by centrifugal force. The liquid flows through a central area into the intake of the pump. The gas is discharged out gas discharge ports into the annulus surrounding the pump. Gas in the annulus collects at the surface of the well and is often introduced through a check valve back into the production flowline at the surface.

Electrical submersible pumps cannot be employed if a well produces principally gas. Gas wells are normally produced by their own internal drive due to the formation pressure. In some instances, however, the gas flow is inadequate either due to poor permeability or low pressure. In these instances, generally the wells are not produced.

Gas compressors, of course, have been known in general in industry. Centrifugal gas compressors utilize stages of rotating impellers within stators or diffusers. However, the design is such that they will operate to compress gas, not pump a liquid. Generally, a centrifugal gas compressor must operate at a much higher rotational speed than a liquid pump. To applicant's knowledge, downhole gas compressors have not been employed in connection with producing gas from a well.

SUMMARY OF THE INVENTION

In this invention, a downhole gas compressor is employed for compressing gas produced in a well and for transferring the gas to a selected location. The gas compressor is a centrifugal type driven by a downhole electrical motor. The higher speed required by the gas compressor may be handled by the electrical motor itself, or it may be handled by a speed increasing transmission.

In one application, a well may be producing predominantly gas with small amounts of liquid. In that instance, a centrifugal pump may be mounted to the lower end of the same electrical motor that drives the gas compressor. The pump is mounted with its discharge facing downward. A packer seals the discharge from the intake of the pump.

Disposal zone perforations are located below the packer. A mixture of liquid and gas flows in through the producing formation perforations into the well. Separation occurs due to gravity or by a gas separator, with the liquid flowing downward to the intake of the pump and the gas flowing upward to the intake of the gas compressor. The intake of the gas compressor is positioned above the liquid level.

In another instance, the well may be producing predominately liquid but with some gas. In that instance, repressurizing zone perforations may be located above the producing zone perforations. A straddle packer separates these perforations from the production perforations. An electrical submersible pump assembly is installed within the well and configured to discharge liquid into the tubing to flow to the surface. The electrical submersible pump assembly has a gas separator. The outlet ports to the gas separator discharge into the well. A gas compressor is mounted also in the well, with its intake located above the outlet of the gas separator. The outlet of the gas separator leads to the repressurization zone. The gas compressor and the pump would have separate motors in this instance. Operating both motors causes the gas separator to separate gas from the liquid, discharging gas to flow into the gas compressor. The gas compressor pressurizes the gas and transmits it to the repressurizing zone.

DETAILED DESCRIPTION OF THE INVENTION

Figure 1:
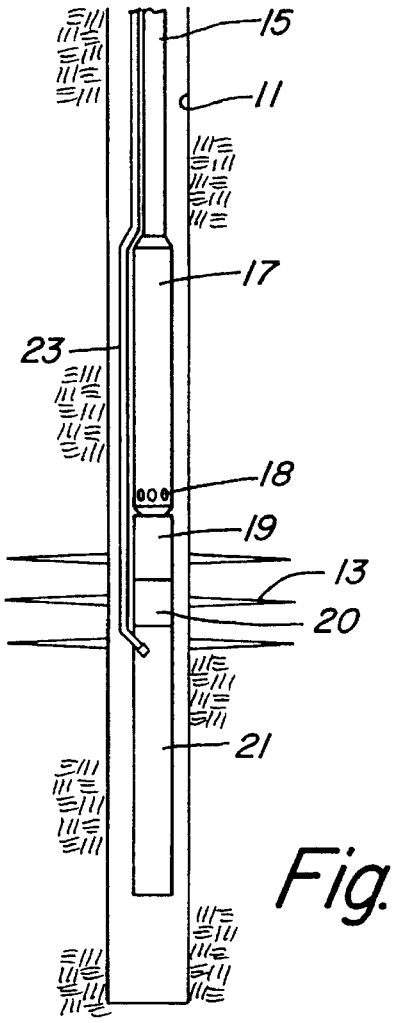
FIG. 1 is a schematic view of a well containing a gas compressor in accordance with this invention.

Referring to FIG. 1, well 11 is a cased well having a set of producing formation perforations 13. Perforations 13 provide a path for gas contained in the earth formation to flow into well 11. A string of tubing 15 extends from the surface into the well. A gas compressor 17 is supported on the lower end of tubing 15. Gas compressor 17 is of a centrifugal type, having a number of stages for compressing gas contained within the well. The outlet or discharge of gas compressor 17 connects to the tubing 15. Intake ports 18 are located at the lower end for drawing in gas flowing from perforations 13.

Gas compressor 17 is shown connected to a speed increasing transmission 19. Transmission 19 is connected on its lower end to a seal section 20 for a three-phase alternating current motor 21, which has a shaft that will drive the transmission 19. Seal section 20 is located at the upper end of motor 21 to seal the lubricant within motor 21 and may be considered a part of the electric motor assembly. Seal section 20 may also have a thrust bearing for handling downthrust created by gas compressor 17. A power cable 23 extends from the surface to motor 21 for supplying electrical power. The output shaft of transmission 19 will drive gas compressor 17 at a substantially higher speed than motor 21.

The speed desired for the gas compressor 17 will be much higher than typical speeds for centrifugal pumps used in oil wells. The speed required is generally proportional to the desired flow rate. Motor 21, if a two-pole motor, typically can be driven by the frequency of the power supplied to rotate in the range from 3500 to 10,500 rpm. For low flow rate production, such as 500 cubic meters per hour, the speed of rotation of gas compressor 17 must be at least 9000 rpm. Higher flow rates of 1500 to 2000 cubic meters per hour require speeds of 20,000 to 30,000 rpm. In FIG. 1, transmission 19 provides the higher speeds, however, if only lower flow rates are desired, transmission 19 may be eliminated.

Figure 2:
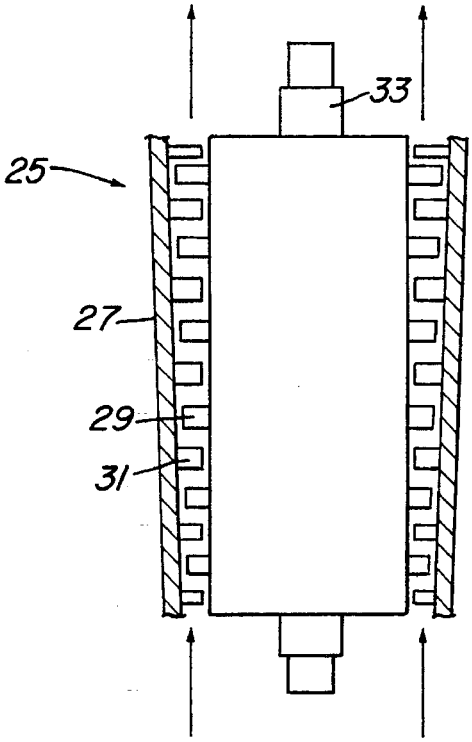
FIG. 2 is a sectional view of a portion of an axial flow gas compressor suitable for use with this invention.

FIG. 2 illustrates an axial flow compressor 25 which may be used for gas compressor 17 in FIG. 1. Axial flow compressor 25 has a tubular housing 17 containing a large number of impellers 29. Impellers 29 are rotated within stator 31, which may be also referred to as a set of diffusers. A shaft 33 rotates impellers 29. Each stage of an impeller 29 and stator 31 results in a greater increase in pressure.

Figure 3:
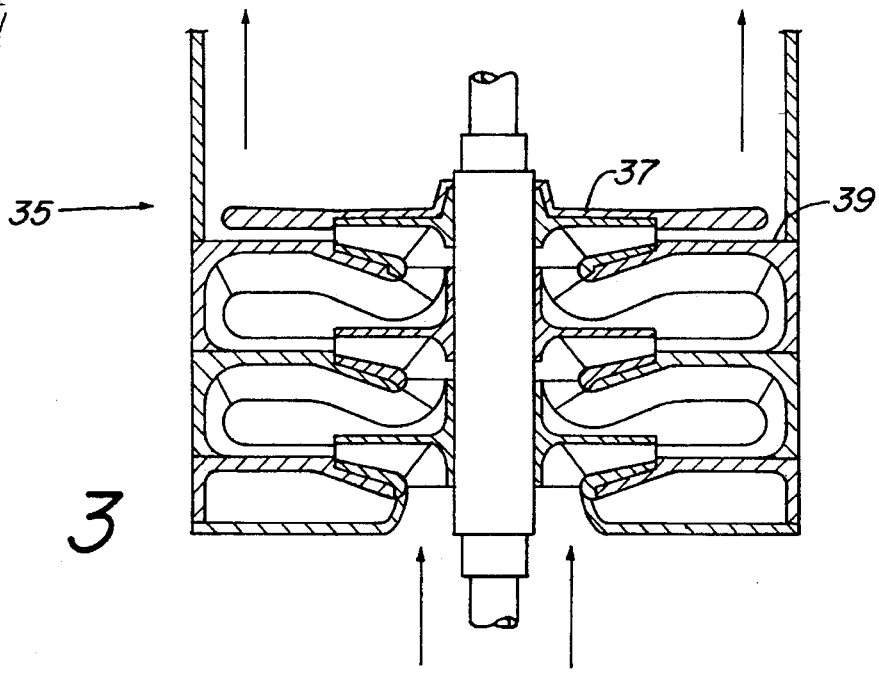
FIG. 3 is a sectional view of a portion of a radial flow gas compressor suitable for use with this invention.

FIG. 3 illustrates a radial flow compressor 35 which may also be used for gas compressor 17 of FIG. 1. Generally, a radial flow compressor, such as compressor 35, produces higher pressures, but at lesser flow rates than axial flow compressor 25. Radial flow compressor 35 has a plurality of impellers 37, each contained within a diffuser 39. The configuration is such that the flow has radial outward and inward components from one stage to the other. In the axial flow compressor 25 of FIG. 2, the flow is principally in an axial direction, with very little outward and inward radial components.

Figure 4:
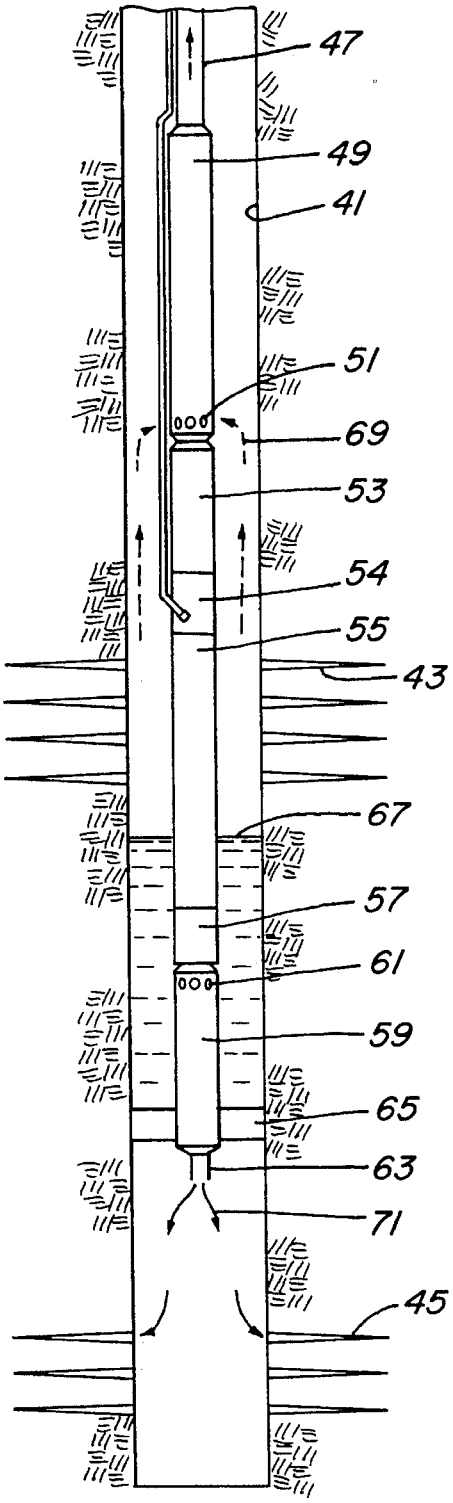
FIG. 4 is a sectional view of a second well having a gas compressor contained therein and also having a liquid pump for disposing of liquid produced along with the gas.

Referring to FIG. 4, in this example, the well is expected to produce principally gas, although small amounts of liquid, usually water with a high salt content, will be produced along with it. In this example, the water is disposed of rather than brought to the surface. Well 41 has production zone perforations 43 which produce gas along with some water. Well 41 will have also disposal zone perforations 45 located below it. A string of tubing 47 extends from the surface into the well. A gas compressor 49 is connected to the lower end of tubing 47. Gas compressor 49 has inlet ports 51 which receive gas from the annulus contained within well 41.

A transmission 53 increases the speed of compressor 49 above that of the electrical motor 55. As part of the electric motor assembly, a seal section 54 is located at the upper end of motor 55 to seal lubricant within electrical motor 55. Seal section 54 may also have a thrust bearing for absorbing axial thrust created by gas compressor 49. A pump 59 is located on the lower end of a seal section 57 located at the lower end of motor 55. Seal section 57 seals the lower end of motor 55 against the egress of water and equalizes internal lubricant pressure with the hydrostatic pressure of the water. Seal section 57 also has a thrust bearing for absorbing axial thrust created by pump 59. Pump 59 has intake ports 61 on its upper end and a discharge 63 on its lower end. An isolation packer 65 seals pump 59 to the casing of well 41 between discharge 63 and intake ports 61. Pump 59 is a rotary pump which is operated by motor 21. Preferably, it is a conventional centrifugal pump, having a number of stages, each having an impeller and a diffuser.

In the operation of the well 41 of FIG. 4, motor 55 will drive both pump 59 and gas compressor 49. The gas and liquid flowing through perforations 43 separates by gravity, with the water flowing downward in well 41 onto packer 65. Pump 59 is designed to allow a liquid level 67 to build up above intake port 61. Liquid level 67 will be below gas compressor intake ports 51, as entry of liquid into gas compressor 49 is detrimental. Pump 59 will pump liquid, as indicated by arrow 71, into the disposal perforations 45. The dotted arrows 69 indicate the flow of gas into gas compressor inlet 51. Gas compressor 49 compresses the gas and pumps it through tubing 47 to the surface for processing at the surface.

Figure 5:
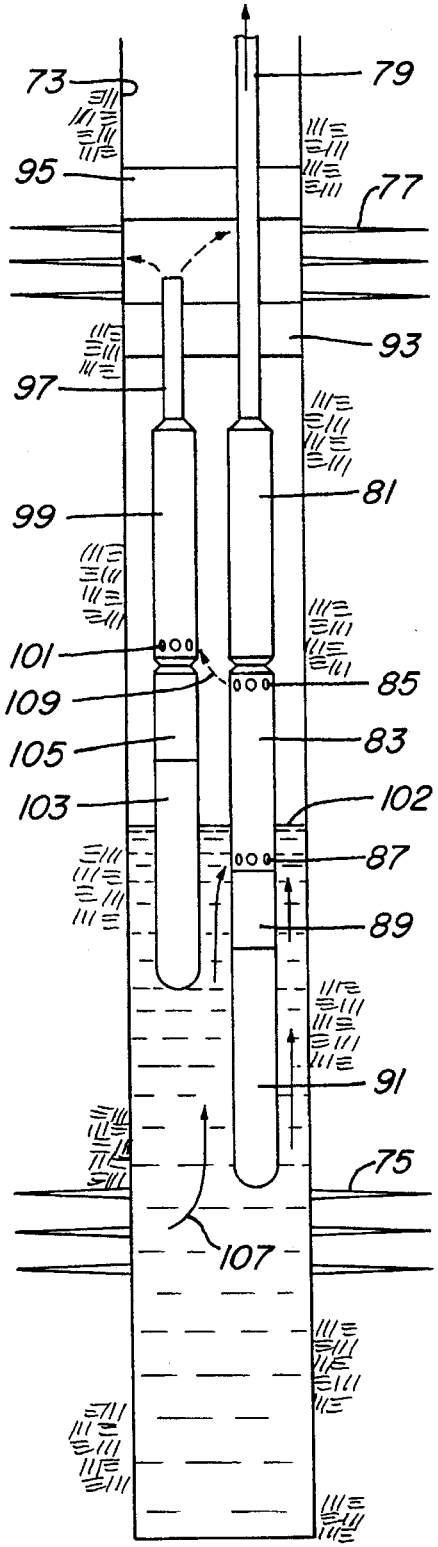
FIG. 5 is a schematic view of a third well containing a gas compressor and a liquid pump, with the gas compressor discharging into a repressurizing zone and the liquid pump discharging liquid to the surface.

In well 73 of FIG. 5, the liquid is produced to the surface, as it will be containing commercial quantities of oil. In this instance, the gas is shown being utilized downhole for repressurizing purposes. However, the gas could also be produced to the surface if desired. Well 73 is similar to the wells previously mentioned, except that it will typically be of somewhat larger diameter. It will have production zone perforations 75. In this example, it will have repressurizing zone perforations 77 located above production zone perforation 75. A string of tubing 79 extends from the surface to a conventional electrical centrifugal submersible pump 81. Pump 81 is connected to a gas separator 83. Gas separator 83 may be of a conventional design such as shown in U.S. Pat. No. 5,207,810, May 4, 1993. Separator 83 has rotating components which through centrifugal force separate the heavier liquid from the lighter gas components. Liquid flows up a central area into the intake of pump 81. The gas flows out gas discharge ports 85 into well 73. Gas separator 83 has intake ports 87 on its lower end. As part of the motor assembly, seal section 89 is employed between gas separator 83 and motor 91. Seal section 89 is conventional and equalizes hydrostatic pressure on the outside of motor 91 with the pressure inside. Seal section 89 also has a thrust bearing for absorbing axial thrust created by pump 81.

A pair of packers 93, 95 isolate the repressurizing zone perforations 77. Tubing 79 extends sealingly through packers 93, 95. A discharge pipe 97 also extends through the lower packer 93, for discharging gas into the perforations 77 between the packers 93, 95. A gas compressor 99 is connected to discharge pipe 97. Gas compressor 99 has a lower intake 101 which is spaced above liquid level 102 in well 73. Intake 101 is also spaced above gas separator outlet ports 85 so that the gas will flow upward and into intake ports 101. An electrical motor 103 having a seal section 105 is connected to the lower end of gas compressor 99 for driving it in the same manner as previously described.

In the operation of the embodiment of FIG. 5, gas and liquid flow in from producing perforations 75. As indicated by the arrows 107, the mixture flows upward and into gas separator intake ports 87. Gas separator 83 separates a substantial portion of the gas from the liquid, with arrows 109 indicating the gas discharged from gas discharge ports 85. The liquid flows into pump 81, and from there it is pumped to the surface through tubing 79. Gas compressor 99 pressurizes the separated gas and forces it into the repressurizing zone perforations 77 to repressurize the gas cap area of the earth formation. Some free gas from production zone 75 will flow directly into gas compressor intake 101, bypassing gas separator 83.

The invention has significant advantages. The use of a downhole gas compressor allows the recovery of gas which lacks sufficient natural drive to flow to the surface. Employing a pump with the gas compressor allows optionally the recovery of the gas and the disposal of liquid in one instance. In another instance, it allows the recovery of liquid with the gas being used downhole for repressurizing.

While the invention has been shown in only a few of its forms, it should be apparent to those skilled in the art that it is not so limited, but is susceptible to various changes without departing from the scope of the invention. For example, a gas separator such as shown in FIG. 5 could also be employed in FIG. 4 to augment the separation of liquid and gas by gravity.

We claim:

1. An apparatus for handling gas and liquid produced by a well, comprising in combination:

a string of tubing extending into the well from the surface;

a centrifugal gas compressor located at a lower end portion of the string of tubing within the well, the gas compressor having an intake for receiving gas in the well, compressing the gas and delivering the gas out a discharge to a selected gas delivery location;

a downhole electric motor assembly connected to the gas compressor for rotating the gas compressor;

a liquid pump located located at the lower end portion of the string of tubing and having an intake below the intake of the gas compressor in the well and having a discharge for pumping liquid in the well to a selected liquid delivery location; and wherein a selected one of the discharges of the gas compressor and the liquid pump is in fluid communication with the string of tubing for selectively delivering the gas or the liquid to the surface.

2. The apparatus according to claim 1, wherein the discharge of the gas compressor is in fluid communication with the string of tubing and the selected gas delivery location is at the surface.

3. The apparatus according to claim 1, wherein the selected gas delivery location is a repressurizing zone located in the well, and wherein the discharge of the gas compressor is connected to a conduit leading to the repressurizing zone.

4. The apparatus according to claim 1, wherein;

the selected liquid delivery location is a liquid disposal zone in the well; and the selected gas delivery location is through the string of tubing to the surface.

5. The apparatus according to claim 1, wherein:

the selected gas delivery location is a repressurizing zone in the well;

the discharge of the gas compressor is connected to a conduit leading to the repressurizing zone for transmitting the gas from the gas compressor into the repressurizing zone; and the selected liquid delivery location is through the string of tubing to the surface of the well.

6. The apparatus according to claim 1, further comprising:

a gas separator mounted below the pump, the gas separator having a lower intake for receiving liquid and gas from the well, for separating a substantial portion of the gas from the liquid, for delivering the separated liquid to the intake of the pump, and for delivering the separated gas to the intake of the compressor.

7. An apparatus for producing gas from a well which contains liquid and gas, comprising in combination:

a centrifugal gas compressor supported on a string of tubing within the well, the compressor having a lower intake for receiving the gas in the well and an upper discharge which discharges the gas at a higher pressure into the string of tubing, the intake being positioned above a liquid level within the well to reduce entry of liquid into the compressor;

an electric motor assembly secured to the lower end of the gas compressor for rotating the gas compressor;

a liquid pump mounted to the lower end of the motor assembly and driven by the motor assembly, the pump having an upper intake positioned below the liquid level within the well and a lower discharge for pumping the liquid downward within the well to a liquid disposal zone; and a packer located between the intake and discharge of the pump for isolating the intake and discharge of the pump.

8. The apparatus according to claim 7, further comprising:

a transmission located between the motor assembly and the compressor for changing the speed of rotation of the compressor relative to the speed of rotation of the motor assembly.

9. An apparatus for producing liquid from a well which also contains gas, comprising in combination:

a centrifugal liquid pump supported on a string of tubing within the well, the pump having a lower intake and an upper discharge which discharges liquid into the tubing;

a gas separator mounted below the pump, having a lower intake for receiving gas and liquid, an upper liquid discharge for discharging liquid to the pump, and an upper gas discharge;

an electrical pump motor assembly mounted below the gas separator for driving the pump;

a gas compressor within the well having an intake in communication with the gas discharge of the gas separator, and a gas discharge for delivering the gas compressed to a higher pressure to a selected location; and an electrical compressor motor assembly mounted below the gas compressor for driving the gas compressor.

10. The apparatus according to claim 9, wherein the selected location for delivery of the compressed gas comprises a repressurizing zone within the well.

11. The apparatus according to claim 9, wherein the intake for the gas compressor is in communication with the well and is located above the gas discharge of the gas separator, which discharges into the well.

12. A method of handling gas and liquid produced by a well, comprising:

connecting a centrifugal gas compressor to an upper end of an electrical motor assembly;

placing the gas compressor and motor assembly in the well, with an intake of the gas compressor in communication with the gas and a discharge leading to a selected gas delivery location;

placing a liquid pump in the well with an intake of the pump in communication with the liquid and a discharge leading to a selected liquid delivery location;

supplying power to the motor assembly and rotating the gas compressor to compress the gas and deliver it to the selected gas delivery location; and pumping the liquid with the pump to the selected liquid delivery location.

13. The method according to claim 12, wherein the selected liquid delivery location is a liquid disposal zone located in the well and wherein the method further comprises:

mounting the pump to the motor assembly, and providing the pump with an intake and a discharge;

isolating the discharge of the pump from the intake of the pump; and driving the pump with the motor assembly and pumping the liquid to the disposal zone.

14. The method according to claim 12, wherein:

the selected gas delivery location is at the surface of the well;

the selected liquid delivery location is a liquid disposal zone located in the well; and wherein the method further comprises:

mounting the pump to a lower end of the motor assembly, and providing the pump with an upper intake and a lower discharge;

placing a packer between the discharge of the pump and the intake of the pump; and driving the pump with the motor assembly and pumping the liquid downward to the disposal zone.

15. The method according to claim 12, wherein the selected gas delivery location for discharging the gas is a repressurizing zone in an earth formation located above the compressor.

16. The method according to claim 12, wherein:

the selected gas delivery location for discharging the gas is a repressurizing zone in an earth formation located above the compressor; and the selected liquid delivery location is at the surface.

17. A method of producing gas from a well which produces liquid and gas, comprising:

connecting a centrifugal gas compressor to an upper end of an electrical motor assembly;

connecting a liquid pump to a lower end of the motor assembly, with a discharge of the pump on a lower end of the pump and an intake of the pump on an upper end of the pump;

lowering the compressor, motor assembly and pump on a string of tubing into the well;

isolating by a packer the intake of the pump from the discharge of the pump;

providing a disposal zone in the well below the packer; and supplying power to the motor assembly to drive the pump and compressor, causing the gas to be compressed and delivered to the surface through the tubing, and causing liquid to be pumped into the disposal zone.

18. The method according to claim 17, wherein the liquid has a level within the well above the packer and wherein the gas compressor has an intake located above the liquid level and the intake of the pump is below the liquid level.

19. A method of producing liquid from a well which also produces gas, comprising in combination:

connecting a lower intake of a centrifugal liquid pump to a liquid discharge port of a gas separator and connecting the gas separator to an electrical pump motor assembly;

connecting a centrifugal gas compressor to an electrical compressor motor assembly;

positioning the gas compressor and compressor motor assembly in the well with a discharge of the gas compressor leading to a selected location;

positioning the liquid pump, gas separator and pump motor assembly in the well, with an upper discharge port of the pump connected to a string of tubing leading to the surface and a gas discharge port of the gas separator in communication with an intake of the compressor; then supplying power to the pump motor assembly and compressor motor assembly, causing liquid separated by the gas separator to flow up the tubing and gas separated by the gas separator to flow to the compressor and from there to the selected location.

20. The method according to claim 19 wherein the selected location is a gas repressurizing zone located above the compressor.

* * * * *